US008689778B1

(12) United States Patent
Flores

(10) Patent No.: US 8,689,778 B1
(45) Date of Patent: Apr. 8, 2014

(54) MASONRY CUTTING DEVICE

(75) Inventor: Daniel Flores, Las Cruces, NM (US)

(73) Assignee: Kolmar Investments, LLC., Las Cruces, NM (US)

( * ) Notice: Subject to any disclaimer, the term of this patent is extended or adjusted under 35 U.S.C. 154(b) by 341 days.

(21) Appl. No.: 13/085,543

(22) Filed: Apr. 13, 2011

(51) Int. Cl.
*B28D 1/32* (2006.01)

(52) U.S. Cl.
USPC ..... 125/23.01; 225/103

(58) Field of Classification Search
USPC ..... 125/13.01, 23.01
See application file for complete search history.

(56) References Cited

U.S. PATENT DOCUMENTS

| | | | | | |
|---|---|---|---|---|---|
| 2,613,661 | A * | 10/1952 | Huber | 125/23.01 |
| 2,657,681 | A * | 11/1953 | Gatzke | 125/23.01 |
| 2,779,324 | A * | 1/1957 | Schlough et al. | 125/23.01 |
| 2,933,079 | A * | 4/1960 | Gutting | 125/23.01 |
| 3,659,722 | A * | 5/1972 | Carroll | 211/106 |
| 4,348,965 | A * | 9/1982 | Swanson | 108/152 |
| 4,777,888 | A * | 10/1988 | Waterman et al. | 108/108 |
| 5,253,770 | A * | 10/1993 | Rosenthal | 211/133.3 |
| 5,305,834 | A * | 4/1994 | White | 171/63 |
| 5,762,061 | A * | 6/1998 | Bevan | 125/23.01 |
| 5,947,104 | A * | 9/1999 | Li | 125/23.01 |
| 6,050,255 | A * | 4/2000 | Sievert | 125/23.01 |
| 6,240,913 | B1 * | 6/2001 | Snell | 125/23.01 |
| 6,401,706 | B1 * | 6/2002 | Hernblom et al. | 125/23.01 |
| 6,568,577 | B2 * | 5/2003 | Baird et al. | 225/103 |
| 7,107,982 | B1 * | 9/2006 | Lechner | 125/23.01 |
| 7,708,005 | B2 * | 5/2010 | Lackner | 125/23.01 |
| 2008/0210213 | A1 * | 9/2008 | Berg | 125/23.01 |
| 2010/0269811 | A1 * | 10/2010 | Snell | 125/23.01 |

OTHER PUBLICATIONS

Zinko Commercial Hydraulic Jack Manual—"Zinko Hydraulic Jack—ZMJ manual.PDF" 2006.*

Zinko Commercial Hydraulic Jack Operating Instructions—"Zinko Hydraulic Jack ZMJ series Operating Instructions" Feb. 2006.*

* cited by examiner

*Primary Examiner* — Lee D Wilson
*Assistant Examiner* — Marc Carlson
(74) *Attorney, Agent, or Firm* — Neustel Law Offices

(57) ABSTRACT

The masonry cutting device generally includes a portable, lightweight frame having an integral upper cutting edge and a center space, a lifting device supported by the frame within the center space and below the upper cutting edge, wherein the lifting device moves a lower cutting edge towards the upper cutting edge for cutting a masonry item between thereof. The lower cutting edge is attached to a guide member which includes slotted ends for travelling along the frame to keep the lower cutting edge in alignment with the upper cutting edge. The lifting device is generally comprised of a shortened, hydraulic jack having a release member, manually-operable handle, and optional spacer. Also included are bias members for exerting a downward force upon the guide member and a catch tray generally comprised of a wired grid that is removable upon the frame and used to catch the cut masonry items.

20 Claims, 6 Drawing Sheets

MASONRY CUTTING DEVICE

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to a cutting device and more specifically it relates to a masonry cutting device for providing a portable and lightweight structure to efficiently cut various types of masonry materials.

2. Description of the Related Art

Any discussion of the related art throughout the specification should in no way be considered as an admission that such related art is widely known or forms part of common general knowledge in the field.

Various cutting devices have been utilized in the past to cut masonry items. Such items generally include primitive structures which do not provide an accurate cut and/or large, heavy structures that require external power sources and are not easily transported to different locations. Because of the inherent problems with the related art, there is a need for a new and improved masonry cutting device for providing a portable and lightweight structure to efficiently cut various types of masonry materials.

BRIEF SUMMARY OF THE INVENTION

A system for providing a portable and lightweight structure to efficiently cut various types of masonry materials. The invention generally relates to a cutting device which includes a portable, lightweight frame having an integral upper cutting edge and a center space, a lifting device supported by the frame within the center space and below the upper cutting edge, wherein the lifting device moves a lower cutting edge towards the upper cutting edge for cutting a masonry item between thereof. The lower cutting edge is attached to a guide member which includes slotted ends for travelling along the frame to keep the lower cutting edge in alignment with the upper cutting edge. The lifting device is generally comprised of a shortened, hydraulic jack having a release member, manually-operable handle, and optional spacer. Also included are bias members for exerting a downward force upon the guide member and a catch tray generally comprised of a wired grid that is removable upon the frame and used to catch the cut masonry items.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview.

Figure 1:
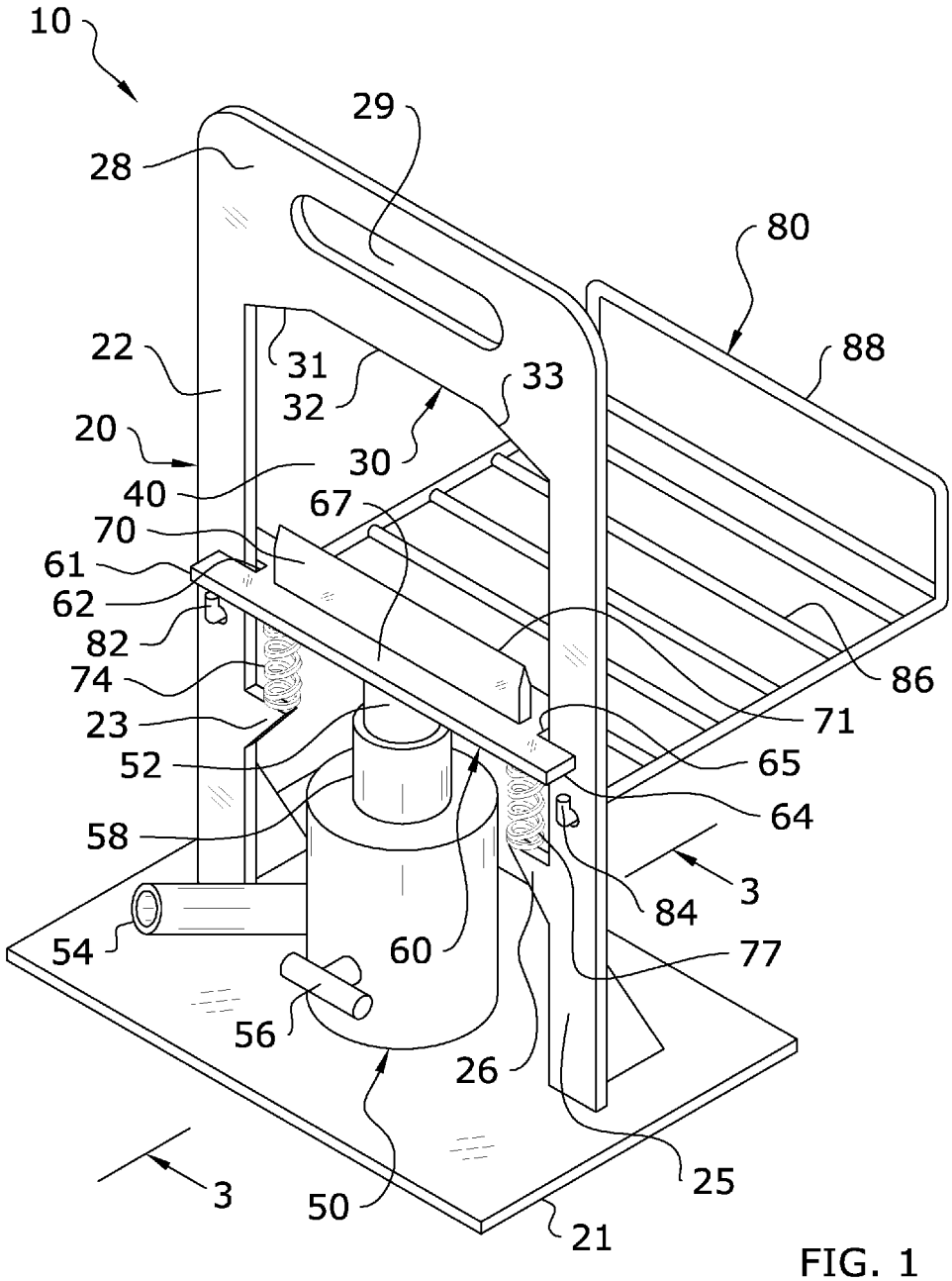
FIG. 1 is a first side upper perspective view of the present invention.
Figure 2:
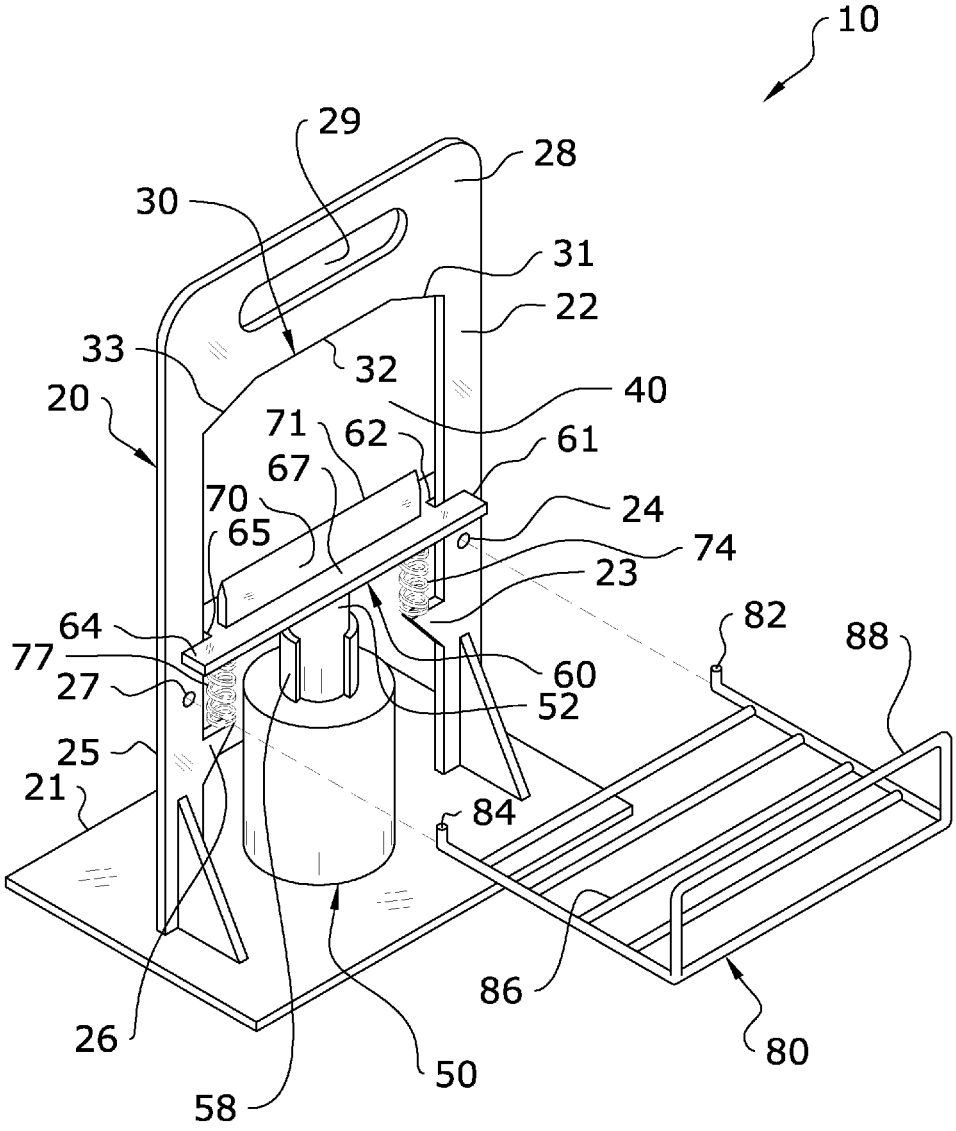
FIG. 2 is a second side upper perspective view of the present invention with the catch tray exploded.
Figure 3:
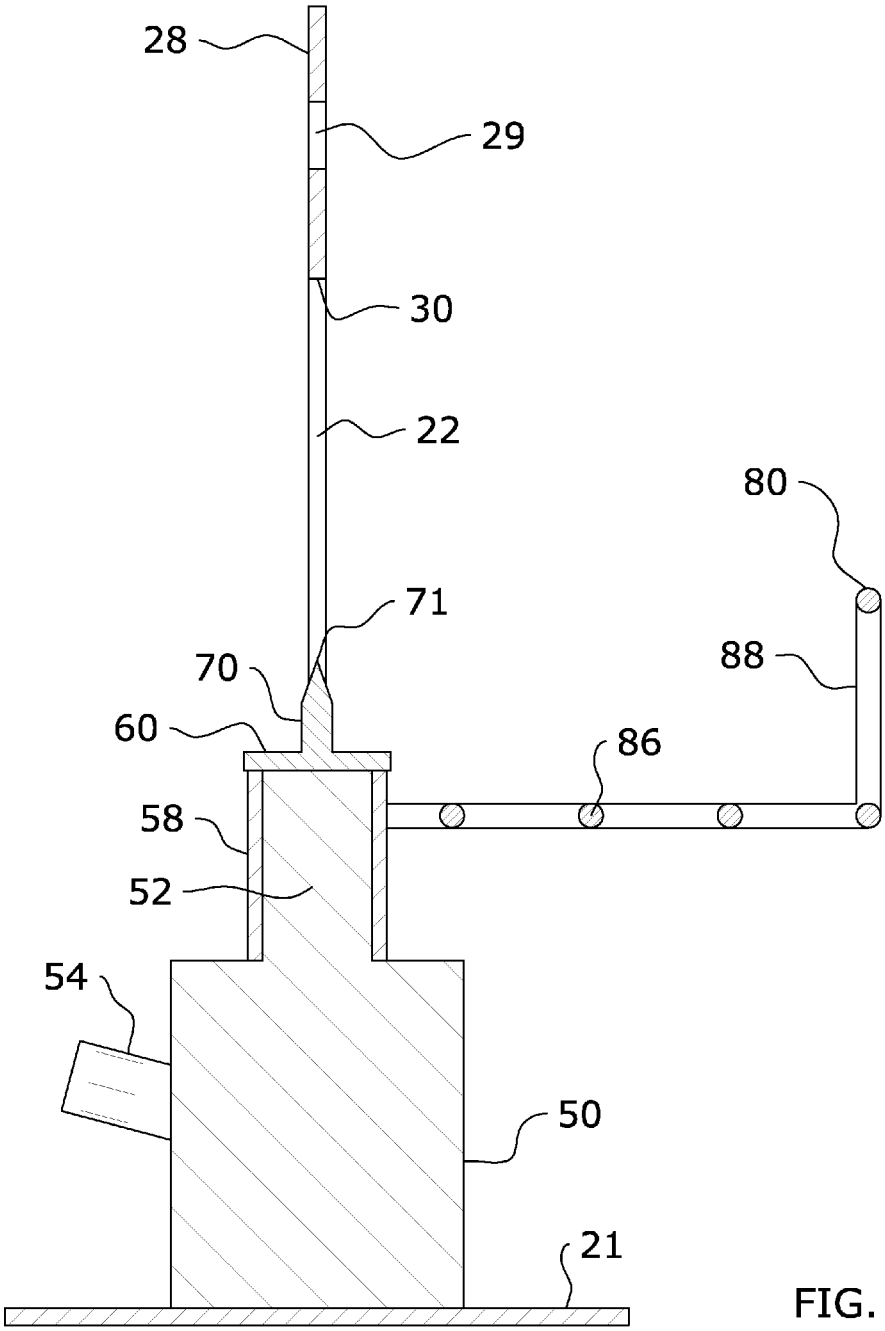
FIG. 3 is a sectional taken along lines 3-3 of FIG. 1.
Figure 4:
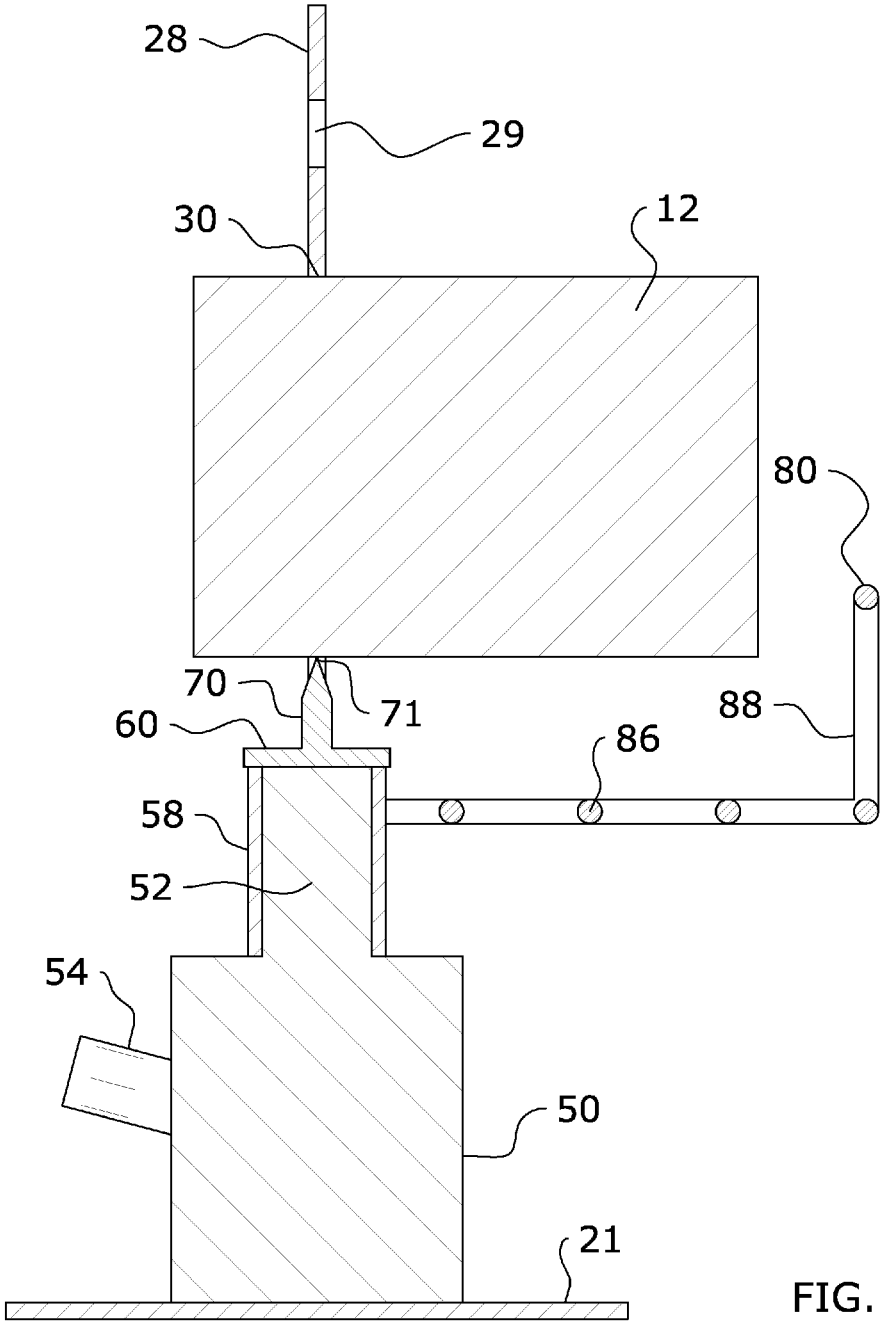
FIGS. 4-6 are cross-sectional views of the present invention in use.
Figure 5:
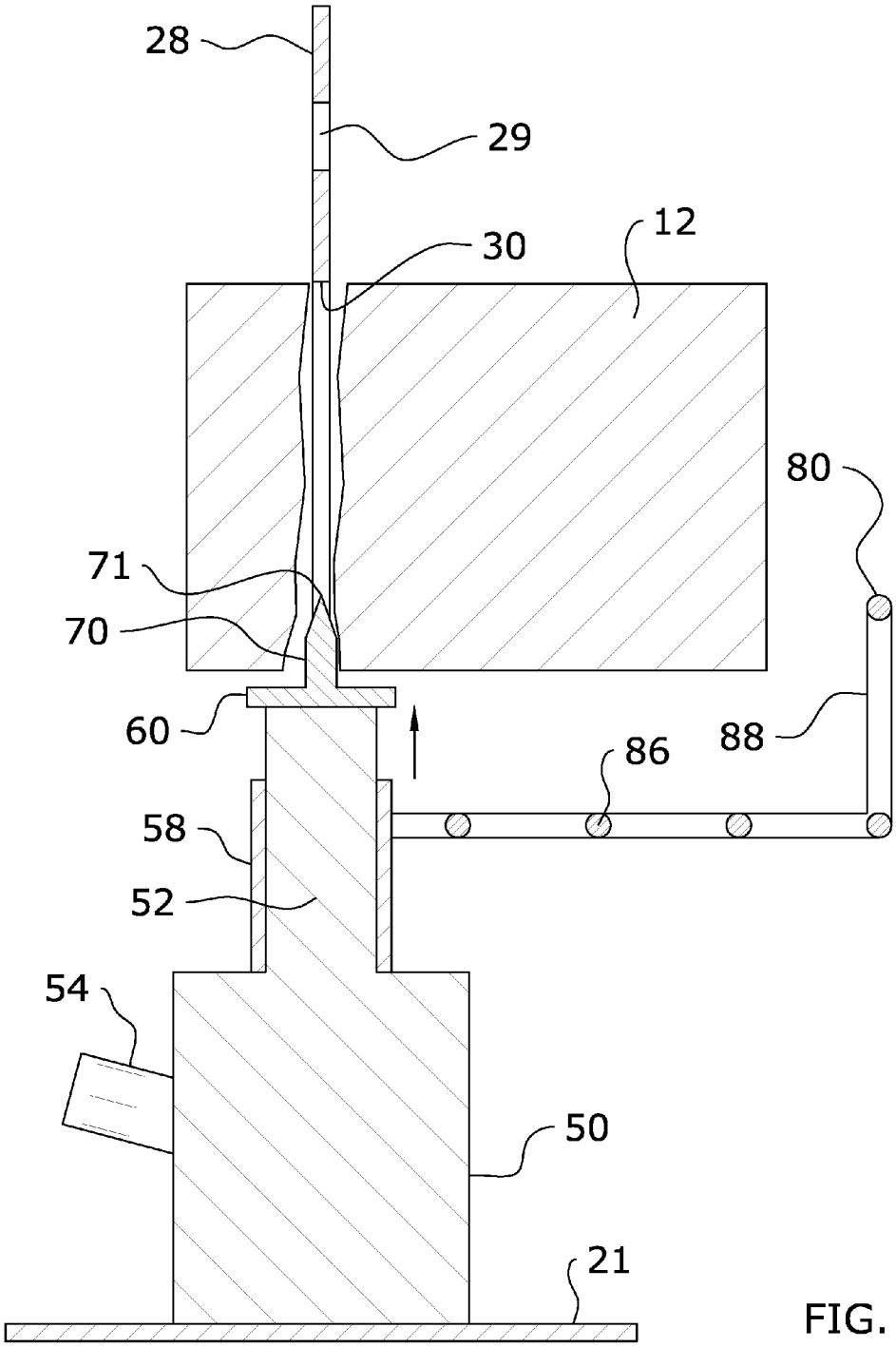
Figure 6:
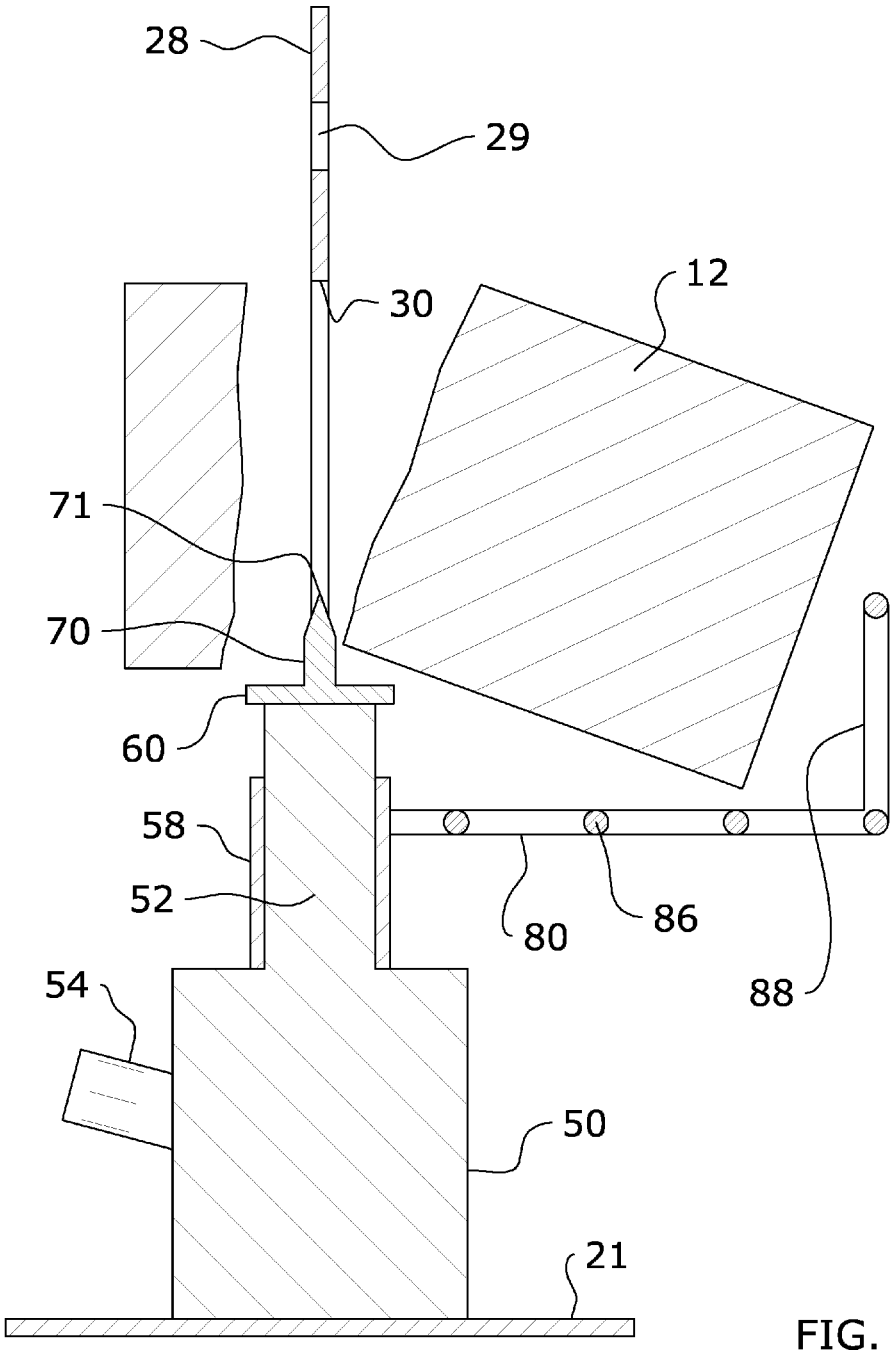

Turning now descriptively to the drawings, in which similar reference characters denote similar elements throughout the several views, FIGS. 1 through 6 illustrate a masonry cutting device 10, which comprises a portable, lightweight frame 20 having an integral upper cutting edge 30 and a center space 40, a lifting device 50 supported by the frame 20 within the center space 40 and below the upper cutting edge 30, wherein the lifting device 50 moves a lower cutting edge 71 towards the upper cutting edge 30 for cutting a masonry item between thereof. The lower cutting edge 71 is attached to a guide member 60 which includes slotted ends 61, 64 for travelling along the frame 20 to keep the lower cutting edge 71 in alignment with the upper cutting edge 30.

The lifting device 50 is generally comprised of a shortened, hydraulic jack having a lifting member 52, release member 56, manually-operable lever 54, and optional spacer 58. Also included are bias members 74, 77 for exerting a downward force upon the guide member 60 and a catch tray 80 generally comprised of a wired grid that is removable upon the frame 20 and used to catch the cut masonry items 12. Various types of masonry items may be used with the present invention, such as stone, brick, and cement, among others.

B. Frame.

The frame 20 is generally comprised of a one-piece structure, also generally being lightweight and portable, such as for permitting use in various locations. The frame 20 generally is comprised of a metal structure; however it is appreciated that various plastic or other material components may be alternately used.

The frame 20 includes a base member 21 generally being of a plate structure. Attached on opposing sides of the base member 21 and vertically extending upwards are a first side member 22 and a second side member 25. Each of the side members 22, 25 generally include an extension 23, 26 extending inwardly from the respective side members 22, 25, generally near a lower end of the side members 22, 25. Each of the side members 22, 25 also preferably includes an opening 24, 27 for receiving and permitting removal of the catch tray 80. The openings 24, 27 are generally spaced vertically above the extensions 23, 26, such as in horizontal alignment with the upper end of the lifting member 52 in the lowered position of the lifting member 52. The side members 22, 25 are also straight to permit smooth movement of the guide member 60 along thereof.

Attached in a fixed manner to the upper end of the side members 22, 25 and extending between thereof is a top member 28. The top member 28 has a handle opening 29 for permitting efficient transport of the present invention and an upper cutting edge 30 integral with the top member 28 and frame 20. The upper cutting edge 30 faces downwardly, such as to be oriented towards the center space 40 defined between the top member 28, side members 22, 25, and base member 21. The upper cutting edge 30 has an angled first side 31, a horizontal center 32, and an angled second side 33. The first side 31 and second side 33 angle downwards to permit efficient cutting of irregular shaped masonry items, wider masonry items, and/or masonry items with curved sides.

C. Lifting Device.

The lifting device 50 is supported atop the base member 21 and centered within the center space 40. The lifting device 50 is preferably comprised of a hydraulic jack and includes a lifting member 52 comprised of a ram. The lifting device 50 generally has a height of approximately 4 inches which is important to permit the present invention to be substantially small in size, and thus lightweight and portable. The lifting member 52 is raised via standard pivotal operation of a lever 54. The lever 54 generally has a padded, rubber handle for ergonomic gripping thereof. The lifting device 50 also includes a release member 56 comprised of a rotational key used to release pressure upon the lifting member 52 and permit the lifting member 52 to lower. The release member 56 has a T-handle and is generally fixed to the lifting device 50, thus eliminating the possibility of misplacing the release member 56.

An optional spacer 58 may be used with the lifting member 52 to retain the lifting member 52 in a partially raised position. The spacer 58 is comprised of a ring or half-ring shape and may have various lengths, such as to support the lifting member 52 at various heights. For instance, if multiple smaller masonry items are to be cut, the lifting member 52 may be raised so that a distance between the upper and lower cutting edges 30, 71 is slightly more than the height of the masonry item and the spacer 58 may be positioned around the lifting member 52 so as to be retained there by the upper end of the lifting member 52 and the lifting device 50 and thus prevent the lifting member 52 from lowering past the upper end of the spacer 58 so as to lessen the required pumping of the lever 54.

D. Guide Member, Lower Cutting Blade, and Bias Members.

The guide member 60 is attached to the upper end of the lifting member 52 and spans across the center space 40. The guide member 60 includes a first end 61, a second end 64, and an elongated center portion 67 that extends from the first end 61 to the second end 64. The first end 61 of the guide member 60 includes a slot 62 that receives the first side member 22 and the second end 64 of the guide member 60 includes a slot 65 that receives the second side member 25 thus permitting the first end 61 and the second end 64 to travel simultaneously along the vertical length of the side members 22, 25, such as to stabilize the lower cutting blade 70 and keep the lower cutting blade 70 and lowering cutting edge 71 aligned with the upper cutting edge 30.

The cutting blade 70 is attached to the guide member 60 along the center portion 67 and includes the cutting edge 71 along an upper part of the lower cutting blade 70 such as to face the upper cutting edge 30 of the top member 28 and be aligned. The lower cutting blade 70 and lower cutting edge 71 have a length less than the total length of the upper cutting edge 30 and also less than the width of the center space 40 of the frame 20.

The first and second bias members 74, 77 are attached to opposing ends of the guide member 60 inwardly from the slots 61, 65 and also attached to the extensions 23, 26 of the side members 22, 25. The bias members 74, 77 work to exert a downward force upon the guide member 60 and cutting blade 70 to return the lifting member 52 to a lowered position such as to permit for space between the upper and lower cutting edges 30, 71 to receive another masonry item. The bias members 74, 77 are preferably comprised of extension springs; however other structures may be appreciated. The bias members 74, 77 may also be attached to the side members 22, 25 in alternate embodiments.

E. Catch Tray.

The catch tray 80 is used to catch cut masonry items. The catch tray 80 is thus positioned below the lower cutting edge 71 so that the cut masonry items can fall onto the catch tray 80 and be retained thereon. The catch tray 80 includes a first hooked end 82, second hooked end 84, catch portion 86, and backstop 88. The catch tray 80 is preferably comprised of a wire grid structure; however other shapes and materials may be appreciated.

The first hooked end 82 and second hooked end 84 are removably received within the openings 24, 27 of the first and second side members 22, 25 of the frame 20. The first and second hooked ends 82, 84 also serve to retain the catch portion 86 of the catch tray 80 in a horizontal plane via an elbow structure of the hooked ends 82, 84 which engages the face of the side members 22, 25. It is appreciated that various other attachment structures may be utilized. The backstop 88 extends upwardly from the outer part of the catch portion 86 and is used to retain masonry items upon the catch portion 86 by restricting the masonry items from rolling off of the catch portion 86. The catch tray 80 may also attach or removably attach upon the guide member 60 in alternate embodiments.

F. Operation of Preferred Embodiment.

In use, the lifting member 52 is lowered to a point where the masonry item 12 may be placed within the center space 40 between the upper cutting edge 30 and the lower cutting edge 71. If multiple smaller-height masonry items are to be used, the spacer 58 may be positioned around the lifting member 52 to raise the lowermost position of the lifting member 52 so that less pumping of the lever 54 is required for each masonry item. Once the masonry items is properly located and the cut line of the masonry item is aligned with the upper and lower cutting edges 30, 71, the lifting member 52 is raised via pumping of the lever 54 until point pressure is applied upon the masonry item via the upper and lower cutting edges 30, 71 and the masonry item 12 is cut. The operator holds one end of the masonry item 12 while the other end of the masonry item 12 is allowed to fall upon the catch tray 80.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. In case of conflict, the present specification, including definitions, will control. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A masonry cutting device, comprising:

an integral frame having a plate structure comprising a horizontal top member, a first vertical side member, and a second vertical side member, wherein both side members are secured to and extend from a base, and a center space formed between thereof, wherein said top member has an integral stationary lower edge adapted for being an elongated upper cutting surface, wherein said integral upper cutting surface comprises a horizontal center surface portion, a first angled planar surface portion extending downwardly from a distal end of said center surface portion toward said first vertical side member, and a second angled planar surface portion extending downwardly from an opposite distal end of said center surface portion toward said second vertical side member;

a manually-operable lifting device supported upon said base of said frame below said upper cutting surface and within said center space, wherein said lifting device is adapted for vertical movement relative said frame; and a lower cutting blade having a movable cutting edge in substantially parallel alignment with said horizontal center surface portion of said elongated upper cutting surface and attached to an upper end of said lifting device such that operation of said lifting device causes said movable cutting edge to vertically move along said first vertical side member and said second vertical side member of said frame towards said upper cutting surface for cutting a masonry item between thereof.

2. The masonry cutting device of claim 1, wherein said top member has a handle opening formed therein.

3. The masonry cutting device of claim 1, wherein said upper cutting surface is wider than said movable cutting edge.

4. The masonry cutting device of claim 1, including one or more bias members for exerting a vertically downward force upon said movable cutting edge.

5. The masonry cutting device of claim 4, wherein said one or more bias members are comprised of springs.

6. The masonry cutting device of claim 1, including a guide member attached to an upper end of said lifting device below said movable cutting edge having horizontally opposing slotted ends, wherein said opposing slotted ends travel vertically along said frame for guiding said movable cutting edge in alignment with said upper cutting surface.

7. The masonry cutting device of claim 6, including one or more bias members connecting said guide member to said frame for exerting a vertically downward force upon said movable cutting edge.

8. The masonry cutting device of claim 1, including a catch tray connected to said frame below said movable cutting edge.

9. The masonry cutting device of claim 8, wherein said catch tray comprises:

a first hooked end removably received by said frame;

a second hooked end removably received by said frame;

a catch portion extending from said first hooked end and said second hooked end, wherein said catch portion is within a horizontal plane; and a backstop vertically extending from said catch portion opposite said first hooked end and said second hooked end.

10. The masonry cutting device of claim 1, wherein said lifting device has a height of approximately 4 inches in a lowered position.

11. The masonry cutting device of claim 1, wherein said lifting device includes a lifting member adapted for vertical movement, and including a spacer removably positioned around said lifting member for raising a lowermost position of said lifting member and said movable cutting edge relative said upper cutting surface.

12. The masonry cutting device of claim 1, wherein an upper portion of said frame includes a handle opening.

13. The masonry cutting device of claim 1, wherein said first angled surface portion and said second angled surface portion mirror one another.

14. The masonry cutting device of claim 1, including a catch tray having a catch portion within a horizontal plane, wherein said catch portion is comprised of a wire grid structure having a plurality of elongated members extending parallel with respect to one another.

15. A masonry cutting device, comprising:

an integral frame having a plate structure comprising a horizontal top member, a first vertical side member, and a second vertical side member, wherein both side members are secured to and extend from a base, and a center space formed between thereof, wherein said top member has an integral stationary lower edge adapted for being an elongated upper cutting surface;

wherein said upper cutting surface comprises a horizontal center surface portion, a first angled planar surface portion extending downwardly from a distal end of said center surface portion toward said first vertical side member, and a second angled planar surface portion extending downwardly from an opposite distal end of said center surface portion toward said second vertical side member;

a manually-operable hydraulic jack supported upon said base of said frame and within said center space, wherein said hydraulic jack has a lifting ram adapted for vertical movement relative said frame;

a guide member attached to an upper end of said lifting ram and having horizontally opposing slotted ends, wherein said opposing slotted ends travel vertically along said first vertical side member and said second vertical side member of said frame for ensuring substantially parallel alignment with said horizontal center surface portion of said elongated upper cutting surface;

a cutting blade having a movable cutting edge, wherein said cutting blade is attached to a topmost surface of said guide member and wherein said movable cutting edge is substantially parallel alignment with said horizontal center surface portion of said elongated upper cutting surface one or more bias members connecting said guide member to said frame for exerting a vertically downward force upon said movable cutting edge.

16. The masonry cutting device of claim 15, including a catch tray connected to said frame below said movable cutting edge, wherein said catch tray comprises:

a first hooked end removably received by a first opening of said first vertical side member;

a second hooked end removably received by a second opening of said second vertical side member;

a catch portion extending from said first hooked end and said second hooked end, wherein said catch portion is within a horizontal plane; and a backstop vertically extending from said catch portion opposite said first hooked end and said second hooked end.

17. The masonry cutting device of claim 15, wherein said hydraulic jack includes a lifting member adapted for vertical movement, and including a spacer removably positioned around said lifting member for raising a lowermost position of said guide member and said movable cutting edge relative said stationary upper cutting surface.

18. The masonry cutting device of claim 15, wherein said top member has a handle opening formed therein.

19. The masonry cutting device of claim 15, wherein said upper cutting surface is wider than said movable cutting edge.

20. A masonry cutting device, comprising:

an integral frame having a plate structure comprising a horizontal top member, a first vertical side member, and a second vertical side member, wherein both side members are secured to and extend from a base, and a center space formed between thereof, wherein said top member has an integral stationary lower edge adapted for being an elongated upper cutting surface;

wherein said upper cutting surface comprises a horizontal center surface portion, a first angled planar surface portion, extending downwardly from a distal end of said center surface portion toward said first vertical side member, and a second angled planar surface portion extending downwardly from an opposite distal end of said center surface portion toward said second vertical side member wherein said top member has a handle opening formed therein;

a manually-operable hydraulic jack supported upon said base of said frame and within said center space, wherein said hydraulic jack has a lifting ram adapted for vertical movement relative said frame;

wherein said hydraulic jack includes a T-shaped release member;

wherein said hydraulic jack has a height of approximately 4 inches in a lowered position;

a guide member attached to an upper end of said lifting ram and having horizontally opposing slotted ends, wherein said opposing slotted ends travel vertically along said first vertical side member and said second vertical side member of said frame for ensuring substantially parallel alignment with said horizontal center surface portion of said elongated upper cutting surface;

a cutting blade having a movable cutting edge, wherein said cutting blade is attached to a topmost surface of said guide member and wherein said movable cutting edge is substantially parallel alignment with said horizontal center surface portion of said elongated upper cutting surface;

wherein said upper cutting surface is wider than said movable cutting edge;

one or more bias members connecting said guide member to said frame for exerting a vertically downward force upon said movable cutting edge;

a catch tray connected to said frame below said movable cutting edge, wherein said catch tray comprises, a first hooked end removably received by a first opening of said first vertical side member, a second hooked end removably received by a second opening of said second vertical side member, a catch portion extending from said first hooked end and said second hooked end, wherein said catch portion is within a horizontal plane, and a backstop vertically extending from said catch portion opposite said first hooked end and said second hooked end;

wherein said hydraulic jack includes a lifting member adapted for vertical movement; and a spacer removably positioned around said lifting member for raising a lowermost position of said guide member and said movable cutting edge relative said stationary upper cutting surface.

* * * * *